US011097441B2

(12) United States Patent
Federico et al.

(10) Patent No.: US 11,097,441 B2
(45) Date of Patent: Aug. 24, 2021

(54) SLITTING DEVICES AND METHODS OF USE

(71) Applicant: DelStar Technologies, Inc., Middletown, DE (US)

(72) Inventors: Ronald Federico, Chadds Ford, PA (US); Joel Patrick Trojnar, Smyrna, DE (US)

(73) Assignee: Delstar Technologies, Inc., Alpharetta, GA (US)

( * ) Notice: Subject to any disclaimer, the term of this patent is extended or adjusted under 35 U.S.C. 154(b) by 0 days.

(21) Appl. No.: 15/629,948

(22) Filed: Jun. 22, 2017

(65) Prior Publication Data

US 2018/0370065 A1 Dec. 27, 2018

(51) Int. Cl.
*B26F 3/12* (2006.01)
*B26D 7/10* (2006.01)
(Continued)

(52) U.S. Cl.
CPC ..... *B26F 3/12* (2013.01); *B26D 1/03* (2013.01); *B26D 1/553* (2013.01); *B26D 3/001* (2013.01); *B26D 7/10* (2013.01); *B26F 3/08* (2013.01); *B65H 35/02* (2013.01); *B65H 2301/5155* (2013.01)

(58) Field of Classification Search
CPC . B26D 1/04; B26D 3/162; B26D 7/10; B26D 5/08; B26D 7/30; B26D 7/1818; B26D 7/24; B26D 7/0608; B28D 5/0088; D06H 7/12; Y10T 83/869; Y10T 83/293; Y10T 83/9292; Y10T 83/6612; Y10T 83/4468; Y10T 83/1138; B26F 3/08; B23D 49/02; B23D 57/0007; B23Q 16/001; B65H 26/025
USPC ..... 83/13, 523, 54, 171, 178, 180, 187, 83/425.2, 425.3, 505, 506, 421, 370, 63, 83/307.1, 662, 700, 59, 66, 651.1; 29/2.1–2.24; 30/114, 117, 302, 303, 165, 30/277, 305
See application file for complete search history.

(56) References Cited

U.S. PATENT DOCUMENTS 2,037,856 A * 4/1936 Filippi ..... B26D 1/547 83/651.1
2,261,114 A * 11/1941 Hawk ..... B28B 11/165 83/288
(Continued)

FOREIGN PATENT DOCUMENTS

CN 201633055 U 11/2010
CN 203650563 U 6/2014
(Continued)

OTHER PUBLICATIONS

PCT International Search Report, PCT/IB2018/054598, dated Oct. 26, 2018.
(Continued)

*Primary Examiner* — Ghassem Alie
(74) *Attorney, Agent, or Firm* — Farber LLC

(57) ABSTRACT

A device for slitting a tubular workpiece into strips includes radially disposed cutting members. The device may include a tapered infeed mandrel for maintaining tension on the tubular workpiece being slit and optionally an exit mandrel. In embodiments, the position of the radially disposed cutting members may be adjustable.

23 Claims, 17 Drawing Sheets

(51) Int. Cl.

| | |
|---|---|
| ***B26D 3/00*** | (2006.01) |
| ***B65H 35/02*** | (2006.01) |
| ***B26D 1/03*** | (2006.01) |
| ***B26D 1/553*** | (2006.01) |
| ***B26F 3/08*** | (2006.01) |

(56) References Cited

U.S. PATENT DOCUMENTS

| | | | | | |
|---|---|---|---|---|---|
| 2,484,854 | A * | 10/1949 | Peters | B23D 25/04 | 83/320 |
| 2,692,328 | A * | 10/1954 | Jaye | B26D 7/0616 | 83/170 |
| 2,781,839 | A * | 2/1957 | Bockrath | B26D 1/035 | 83/171 |
| 2,789,199 | A * | 4/1957 | Bjorksten | B26D 1/245 | 219/221 |
| 2,825,969 | A * | 3/1958 | Hoey | A01J 23/00 | 53/519 |
| 2,894,106 | A * | 7/1959 | Jacob | B26F 3/12 | 83/62 |
| 3,026,599 | A * | 3/1962 | Leff | D06H 7/12 | 29/2.16 |
| 3,046,656 | A * | 7/1962 | Bertrand | B26D 3/24 | 83/431 |
| 3,271,838 | A | 9/1966 | Pisani et al. | | |
| 3,500,541 | A * | 3/1970 | Farniok | A01J 21/02 | 425/141 |
| 3,581,344 | A * | 6/1971 | Sederlund et al. | B29C 55/285 | 425/305.1 |
| 3,782,615 | A | 1/1974 | Webster et al. | | |
| 3,961,650 | A | 6/1976 | Marowsky et al. | | |
| 3,986,416 | A | 10/1976 | Wade | | |
| 4,018,116 | A | 4/1977 | Treffner et al. | | |
| 4,047,272 | A * | 9/1977 | King | D06H 7/12 | 242/525.7 |
| 4,059,874 | A * | 11/1977 | Pisani | D06H 7/12 | 29/2.16 |
| 4,084,466 | A * | 4/1978 | Sipusic | A22C 11/104 | 83/193 |
| 4,227,957 | A * | 10/1980 | Keuchel | B26D 3/162 | 156/443 |
| 4,422,587 | A | 12/1983 | Primich | | |
| 4,748,884 | A | 6/1988 | Planeta | | |
| 5,020,403 | A | 6/1991 | D'Angelo et al. | | |
| 5,101,094 | A | 3/1992 | Keller et al. | | |
| 5,806,393 | A | 9/1998 | Saporiti | | |
| 5,893,308 | A * | 4/1999 | Katamachi | B23Q 16/001 | 125/21 |
| 6,041,988 | A | 3/2000 | Shapiro | | |
| 6,502,488 | B1 * | 1/2003 | Taylor | B26D 3/16 | 82/130 |
| 6,575,070 | B1 | 6/2003 | Peyerl et al. | | |
| 6,681,668 | B1 | 1/2004 | Smirle | | |
| 7,775,248 | B2 * | 8/2010 | Cina | B29C 53/60 | 156/425 |
| 8,555,763 | B2 * | 10/2013 | Farid | B26D 3/185 | 30/114 |
| 9,333,662 | B2 | 5/2016 | Kuchina | | |
| 2012/0167733 | A1 * | 7/2012 | Lee | B28D 5/0076 | 83/169 |
| 2016/0001457 | A1 | 1/2016 | Shapiro | | |

FOREIGN PATENT DOCUMENTS

| | | | | |
|---|---|---|---|---|
| EP | 0170586 | A1 | 2/1986 | |
| FR | 7501569 | A | 8/1976 | |
| GB | 191407313 | A * | 5/1914 | B26D 3/24 |

OTHER PUBLICATIONS

PCT Written Opinion of the International Searching Authority, PCT/IB2018/054598.

* cited by examiner

SLITTING DEVICES AND METHODS OF USE

BACKGROUND

1. Technical Field

The present disclosure relates to devices for cutting a tubular workpiece into strips or ribbons.

2. Background of the Related Art

Flat web slitters typically utilize a gang of knives positioned at a precise distance from each other, with the distance being equivalent to the width of the strip desired. This type of slitter arrangement when used on elastomeric webs frequently results in unpredictable strip widths due to non-linear necking that occurs when the flat web is pulled under tension. The tension and amount of necking in between each knife may be variable and therefore the width of the slit strips in a relaxed state may have a high degree of variation.

Slitting a flat web also typically results in trim waste on each of the two edges due to uneven tension at the edge in combination with an inability to accurately control the location of the edge. For this reason, it is common practice in slitting flat webs to produce master rolls slightly wider than the required slit width such that the slitting machine can obtain acceptable cut quality on the edges, generating significant production waste.

Devices for cutting a tubular workpiece into strips or ribbons typically include complex structures to precisely control tension on the tubular workpiece so that accurate and repeatable slit width can be achieved. Inadequate tension tends to generate inconsistent cuts that are not straight. Consistent tension in slitting becomes particularly difficult to overcome when slitting an elastomeric tubular workpiece because of the tendency for the tubular workpiece to neck down (narrow in width) when it is pulled. The amount of "necking" in the width-wise direction of the tubular workpiece is generally equivalent to the amount of "stretch" in the machine direction, although the necking in elastomeric tubular workpieces may not be not linear across the width of the tubular workpiece.

It would be beneficial to provide a simple device for cutting a tubular workpiece into strips or ribbons that achieves consistent tension on the tubular workpiece and thereby accurately provides straight cuts of any desired width.

SUMMARY

The following presents a simplified summary of the claimed subject matter in order to provide a basic understanding of some aspects of the claimed subject matter. This summary is not an extensive overview of the claimed subject matter. It is intended to neither identify key or critical elements of the claimed subject matter nor delineate the scope of the claimed subject matter. Its sole purpose is to present some concepts of the claimed subject matter in a simplified form as a prelude to the more detailed description that is presented later.

The present disclosure relates to devices for cutting tubular workpieces into strips or ribbons. In one aspect, slitting devices in accordance with embodiments of the present disclosure include a frame, an infeed mandrel, and a plurality of radially disposed cutting members supported on the frame.

In another aspect, slitting devices for cutting a tubular workpiece into strips are described that include an infeed mandrel configured to be positioned within, and to expand a diameter of, a tubular workpiece. The devices further include an exit mandrel and a frame positioned between the infeed mandrel and the exit mandrel, with a plurality of cutting members supported on the frame.

In yet another aspect, slitting devices for cutting a tubular workpiece into strips are described that include a plurality of adjustable, radially disposed cutting members. Such embodiments include an infeed mandrel, an exit mandrel, a frame positioned between the infeed mandrel and the exit mandrel. The frame includes a plurality of central apertures on a central portion thereof, where each central aperture is configured to secure a first end of a cutting member, and a plurality of outer apertures positioned on a peripheral portion of the frame, where each outer aperture is configured to secure a second end of the cutting member.

In any of the foregoing embodiments, the plurality of cutting members may be wires. In embodiments, the wires may be made from Nickel Chromium. In embodiments, the device may include a power source, with the wires being heated by the power source. In embodiments, the wires, upon being heated by the power source, are capable of slitting the tubular workpiece without directly contacting the tubular workpiece.

In yet another aspect, methods for cutting a tubular workpiece into strips are described, the methods including positioning a tubular workpiece over an infeed mandrel, and advancing the tubular workpiece across a radial array of cutting members. In embodiments, the infeed mandrel expands the diameter of the tubular workpiece. In embodiments, the tubular workpiece is advanced across a radial array of wires. In embodiments, the wires are heated and cut the tubular workpiece into strips without contacting the tubular workpiece. In embodiments, after passing across the radial array of cutting elements, the resulting strips are pulled over an exit mandrel.

In yet another aspect, strips of material derived from a tubular workpiece are described, the strips being prepared by a method including positioning a tubular workpiece over an infeed mandrel, and advancing the tubular workpiece across a radial array of cutting members.

In yet another aspect, systems for cutting a tubular workpiece into strips are described that include a source of tubular workpiece, a slitting station to form strips or ribbons from the tubular workpiece, a drive mechanism for pulling the tubular workpiece through the slitting station, and a collection station. In embodiments, the source of tubular workpiece is a spool of tubular workpiece stock material. In embodiments, the slitting station includes a plurality of radially disposed cutting members supported on a frame. In embodiments, the slitting station includes a tapered infeed mandrel that expands the diameter of the tubular workpiece. In embodiments, the drive mechanism includes a nip roller. In embodiments, the drive mechanism pulls the strips formed from the tubular workpiece over an exit mandrel. In embodiments, the collection station includes one or more spools upon which the strips are wound. In embodiments, the system further includes a cutting mechanism to cut the strips into desired lengths. In such embodiments, the collection station may be a container into which strips of a desired length are collected.

BRIEF DESCRIPTION OF THE DRAWINGS

The above and other aspects, features, and advantages of the present slitting devices will become more apparent in light of the following detailed description when taken in conjunction with the accompanying drawings in which.

DETAILED DESCRIPTION

Figure 1:
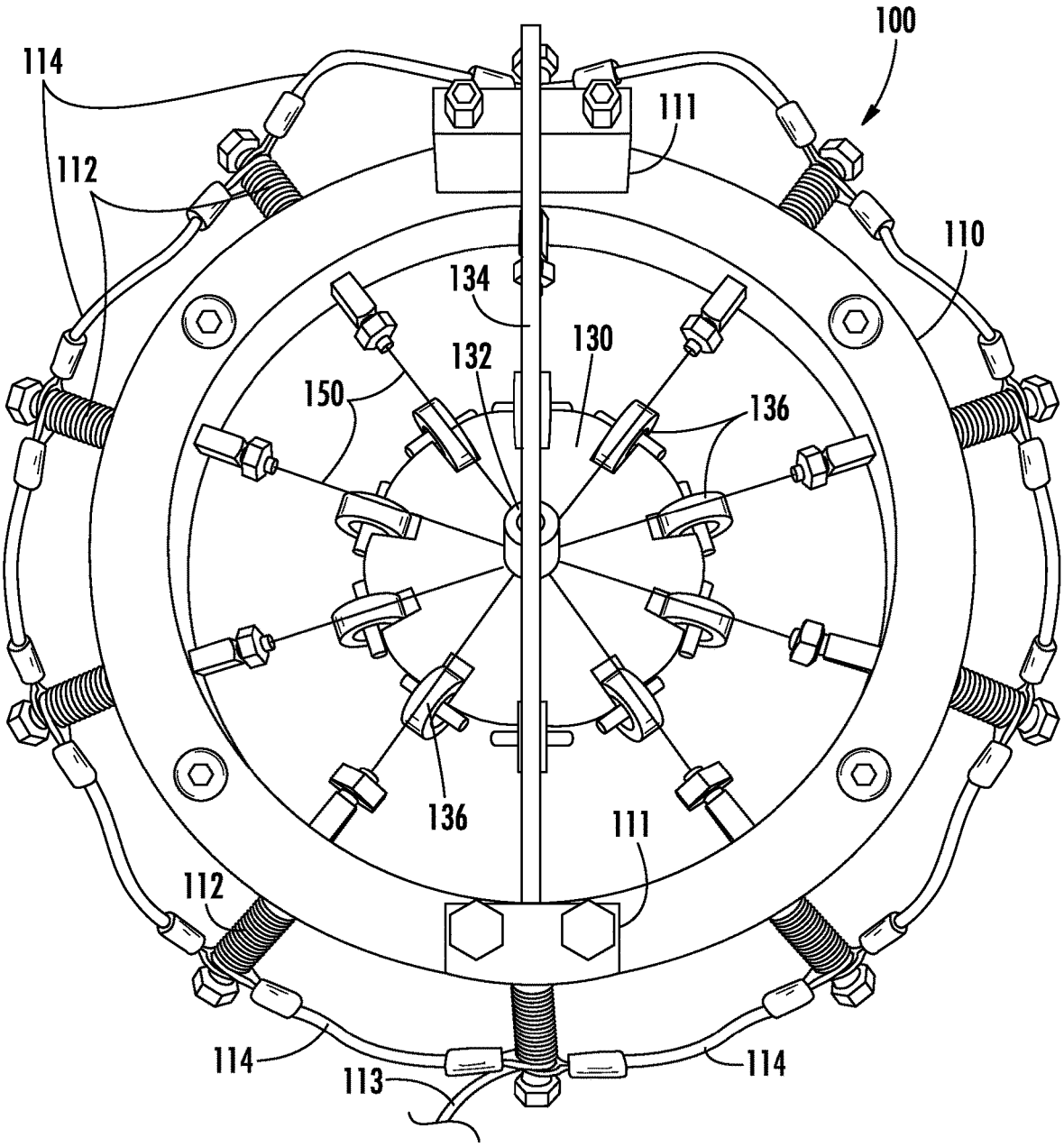
FIG. 1 is a front view of an exemplary embodiment of a slitting device in accordance with the present disclosure.

Particular embodiments of the present devices for cutting strips or ribbons from a tubular workpieces are described hereinbelow with reference to the accompanying drawings; however, it is to be understood that the disclosed embodiments are merely exemplary of the disclosure and the present cutting devices may be embodied in various forms. One skilled in the art will readily recognize from the following discussion that alternative embodiments of the structures and methods illustrated herein may be employed without departing from the principles of the present disclosure described herein. Therefore, specific structural and functional details disclosed herein are not to be interpreted as limiting, but merely as a basis for the claims and as a representative basis for teaching one skilled in the art to variously employ the concepts of the present disclosure in virtually any appropriately detailed structure.

Slitting devices in accordance with illustrative embodiments of the present disclosure are configured to cut tubular workpieces into strips, in some embodiments, simultaneously creating multiple strips of various widths.

Tubular workpieces which can be cut into strips using devices in accordance with the present disclosure include cylindrical structures made from synthetic films, webs, nets, fabrics, plastics, or papers. The tubular workpiece may be made using any technique within the purview of those skilled in the art, including but not limited to extrusion, blow molding, knitting, weaving, and the like. The tubular workpiece may be elastic and may have a thickness, in embodiments, of from about 0.01 mm to about 1 mm. The diameter of the tubular workpiece may, in embodiments, be from about 0.20 cm to about 200 cm. The tubular workpiece can be provided to the slitting device from any suitable source. In embodiments, the source may be a spool of pre-formed stock of the tubular workpiece. In other embodiments, the source may be a tubular workpiece manufacturing device (e.g., a knitting machine, a weaving machine, an extrusion machine, a blow molding machine, or the like) positioned adjacent the slitting device, so that tubular workpiece is provided directly to the slitting device after being created without the need for storage thereof.

In the following description, "upstream" means in the direction of the supply of the tubular workpiece, and "downstream" means in the direction away from the supply of the tubular workpiece.

In an illustrative embodiment shown in FIGS. 1 to 4, slitting device 100 includes frame 110, infeed mandrel 130, and cutting members 150.

Frame 110 supports infeed mandrel 130 and cutting members 150. Frame 110 may be circular as shown or may have any geometric configuration suitable for supporting mandrel 130 and cutting members 150. In embodiments, frame 130 is made from an electrically insulative, thermally stable material, and is sufficiently rigid to support other components of slitting device 100. Suitable materials from which frame 110 can be made include phenolic materials such as phenol-formaldehyde resins and polyoxybenzylmethylenglycolanhydride, more commonly known by their trade names novolacs, resols, or bakelite, and the like. Frame 110 can be made using any technique within the purview of those skilled in the art, such as, for example, molding, machining, and the like, and may be a single piece or multiple pieces secured together.

Figure 2:
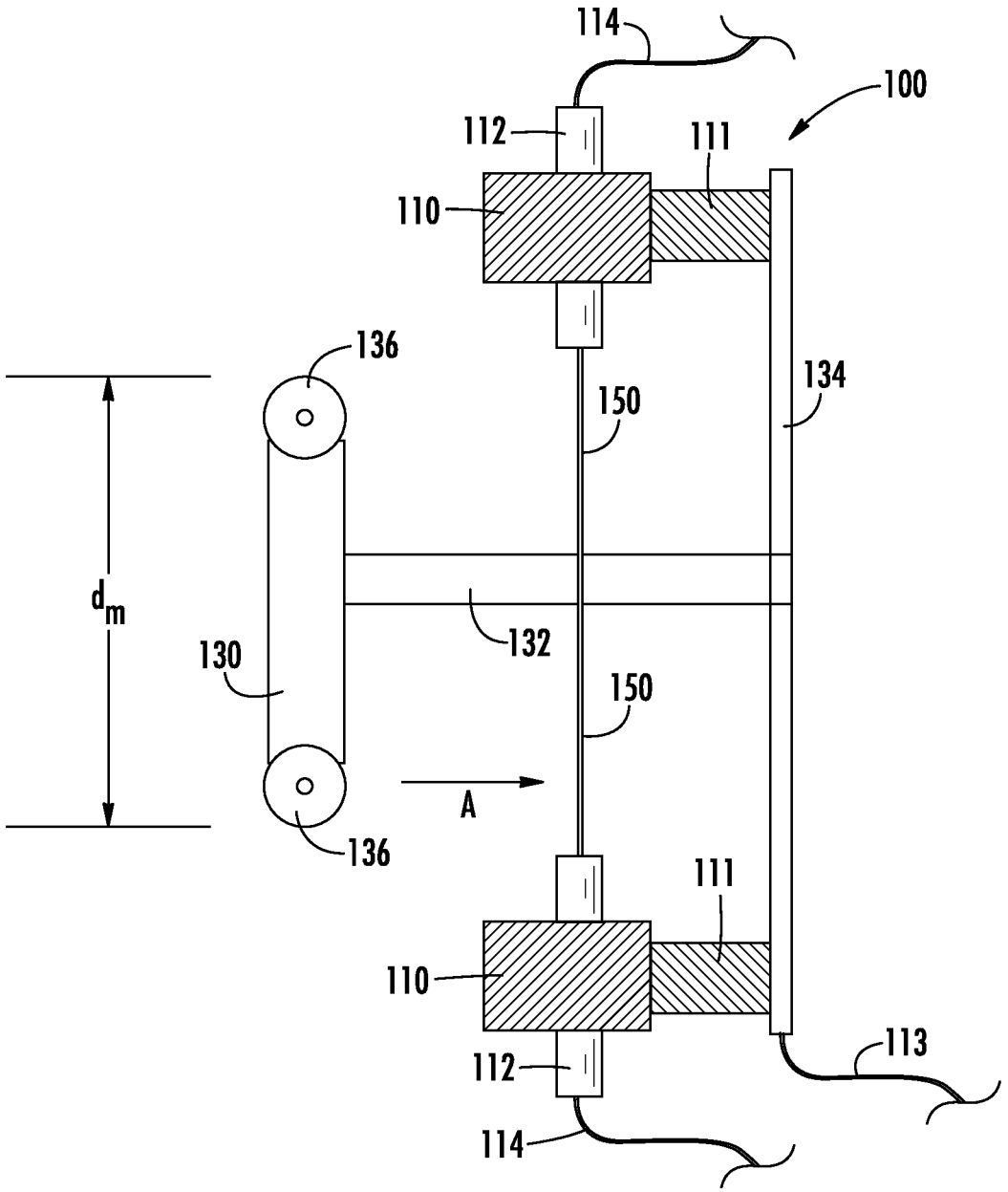
FIG. 2 is a cross-sectional view of the device of FIG. 1.
Figure 3:
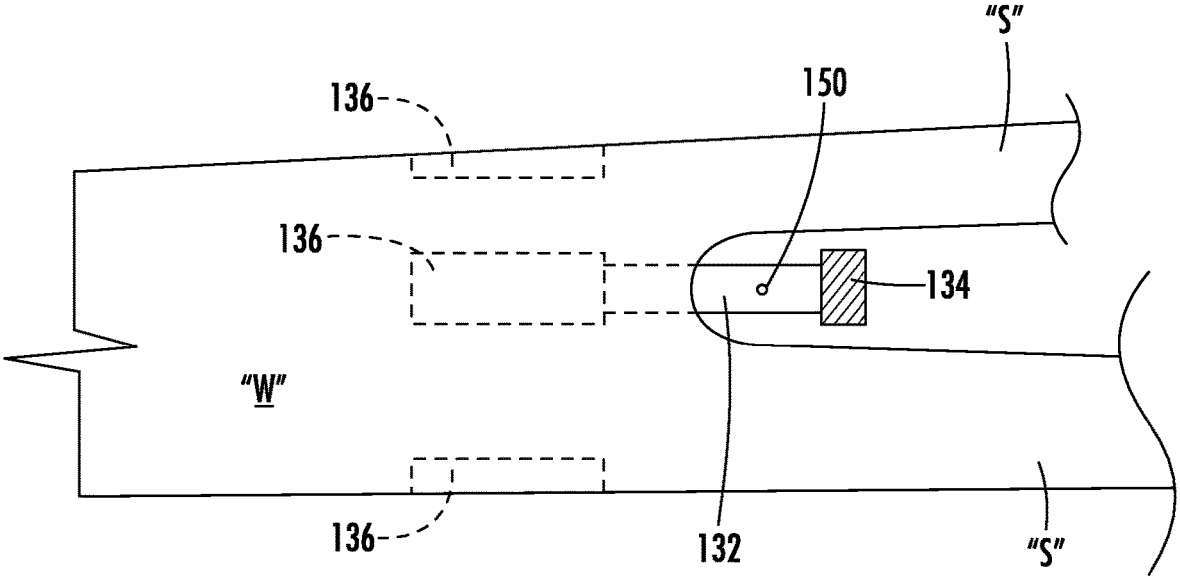
FIG. 3 schematically shows a tubular workpiece being cut by a wire, without contacting the wire.

A strut 134 spans the width of frame 110. Strut 134 is positioned on the downstream side of frame 110 and may be mounted directly to frame 110 or, as shown in FIGS. 1 and 2 may be mounted to blocks 111 which are mounted to frame 110. Blocks 111 may serve as spacers to keep struts 134 a suitable distance from cutting members 150, such that the cut edge of the material does not make contact with strut 134. Additionally, blocks 111 may serve as a precise mount for strut 134 to frame 110. Blocks 111 may be secured to frame 110 and to strut 134 using any method within the purview of those skilled in the art, including welding, fastening (e.g., bolting), adhesives and the like. Strut 134 may be made from any rigid material, and in embodiments is made from an electrically conductive material, such as brass, stainless steel, nickel, aluminum, copper, bronze, titanium, or the like. A center rod 132 is mounted to strut 134 at or near the center of frame 110, extending through frame 110 in the upstream direction from strut 134. Center rod 132 may be made from the same material as strut 134 or may be made form a different material, in embodiments, from an electrically conductive material.

Cutting members 150 are mounted between center rod 132 and frame 110 in a radial array. A first end portion of each cutting member 150 may be mounted to center rod 132 using any technique within the purview of one skilled in the art. For example, the first end portion of each cutting member 150 may be secured within a hole in center rod 132 using a setscrew. A second end portion of each cutting member 150 may be mounted to frame 110 using any technique within the purview of one skilled in the art. For example, the second end portion of each cutting member 150 may be secured to a pin (not shown) extending from frame 110. In embodiments the second end portion of each cutting member 150 is secured to frame 110 under tension via a tensioner, such as a spring or, as shown in FIGS. 1 and 2, spring loaded plungers 112. Spring loaded plungers 112 maintain cutting elements 150 under tension, in embodiments accommodating expansion of the cutting members 150 if they are heated. In embodiments, cutting members 150 may have a first ended attached to spring loaded plungers 112 on one end, and may run directly through the center of frame 110, making electrical contact with central rod 132, but having a second end attached to another spring loaded plunger 112 positioned opposite the first end.

The number of radially disposed cutting members determines the number of strips being cut. While the illustrative embodiment of FIG. 1 includes ten cutting members 150, it should be understood that more or less than ten cutting members may be employed in device 100. The spacing between adjacent cutting members 150 combined with the distance from center rod 132 at which tubular workpiece is moved across cutting members 150 determines the width of the strip or ribbon produced by the device. As those skilled in the art reading this disclosure will appreciate, cutting members 150 may be equally spaced as shown in the illustrative embodiment of FIG. 1, resulting in strips of equal width. Alternatively, irregular spacing between adjacent cutting members will result in strips of different widths. As the cutting members are radially disposed, the position of each cutting member represents a certain number of degrees in a circle. This can be translated to strip width according to the formula $X=Y/360\times Z$, where X=the desired slit width, Y=the circumference of tubular workpiece in relaxed state (no tension), and Z=the degrees between adjacent wires.

Cutting members 150 may be any structure capable of cutting a tubular workpiece. Cutting members 150 can achieve cutting by directly contacting the tubular workpiece, or without directly contacting the tubular workpiece. Suitable cutting members include knives, blades, razors, cords, wires, lasers and the like. In embodiments, cutting members 150 are resistance heated cutting elements such as, for example, wires or strips of material capable of being heated to temperatures sufficient to cut the workpiece through the use of heat alone, without contacting the workpiece.

In a resistance-heated cutting process, electrical current from an external source is conducted through an electrically conductive cutting element (e.g., wire). Heat is generated in the cutting element as a result of resistance to electrical current flow. In embodiments, the cutting element is heated to a temperature sufficiently above the melting point of the material from which the tubular workpiece is made, so that the workpiece is melted before contacting the cutting element. Determining suitable temperatures for cutting various materials is within the purview of one skilled in the art reading this disclosure, and may be determined, for example, based on a variety of factors including the specific material(s) of construction, the density of the workpiece, the thicknesses of the workpiece, and the like.

Electrical current for providing electrical resistance heating may be supplied in any manner known to those skilled in the art, such as through a transformer (not shown) connected by a circuit to the cutting elements. In embodiments, the cutting elements may be wired in parallel to assure uniform heat distribution, and the voltage may be controlled by from a control panel (not shown) including a rheostat and switches for adjusting the voltage in the circuit.

In embodiments, a variable DC transformer (not shown) provides current to wires, which serve as the cutting members. An increase in current results in increased heat in the wires. The operator of the machine can adjust the current setting depending on the material being cut. It may be desirable to use the minimum heat possible while achieving acceptable results to extend the life of the wire. Certain elastomeric materials can be slit without the material coming into contact with the wire. When the heat is suitably adjusted, and the infeed mandrel provides a suitable pre-stretch tension, then the tubular workpiece will split from radiant heat alone, which may extend the life of the wires and minimize generation of smoke, buildup on the wires, or any other undesirable byproduct.

In embodiments, cutting members 150 are resistance wires. The resistance wires may be of any geometric shape, including but not limited to square, flat, or rounded wires. The resistance wires may be made of any suitable material that can be heated to a temperature sufficiently high to cut the workpiece through the use of heat alone, without actually contacting the workpiece. In embodiments, a nickel-chromium (also referred to as nichrome) resistance wire may be used. As those skilled in the art reading this disclosure will appreciate, nichrome wires can withstand temperatures up to 1400 degrees Celsius and are available in a range of sizes, for example from 40 gauge to 8 gauge. One illustrative nichrome wire that may be used in the present devices is a 30 gauge Nickel Chromium wire from McMaster Carr, Elmhurst, Ill.

Spring loaded plungers 112 may be part of the circuit that serves to power cutting elements 150. In embodiments, power may be provided to center rod 132 (either directly or through strut 134 via wire 113), pass through wire cutting members 150, and then through spring loaded plungers 112. Wires 114 may be used to connect spring loaded plungers 112 in parallel, and to provide them with an electric current and to complete the circuit. Accordingly, spring loaded plungers 112 may serve two functionalities: providing electricity to cutting elements 150, and keeping cutting elements 150 under tension even when cutting elements 150 are subjected to elevated temperatures, which in the absence of a spring, could lead to expanding and loosening of cutting elements 150.

Infeed mandrel 130 is mounted to an upstream portion of center rod 132. Infeed mandrel 130 is configured to accept and guide a tubular workpiece as it is fed through the device. Infeed mandrel 130 may have a diameter "$d_m$" (see FIG. 2) slightly larger than the unexpanded or "at rest" diameter of the tubular workpiece to be cut and may include a surface made from a material that facilitates smooth movement of the tubular workpiece over infeed mandrel 130. Alternatively, as shown in the illustrative embodiment of FIG. 1, infeed mandrel 130 may include roller wheels 136. Roller wheels 136 may be positioned near the outer edges of infeed mandrel 130 and help to reduce friction as a tubular workpiece is fed over infeed mandrel 130. In embodiments, a roller wheel 136 is positioned on center in line with each cutting member 150.

Figure 4:
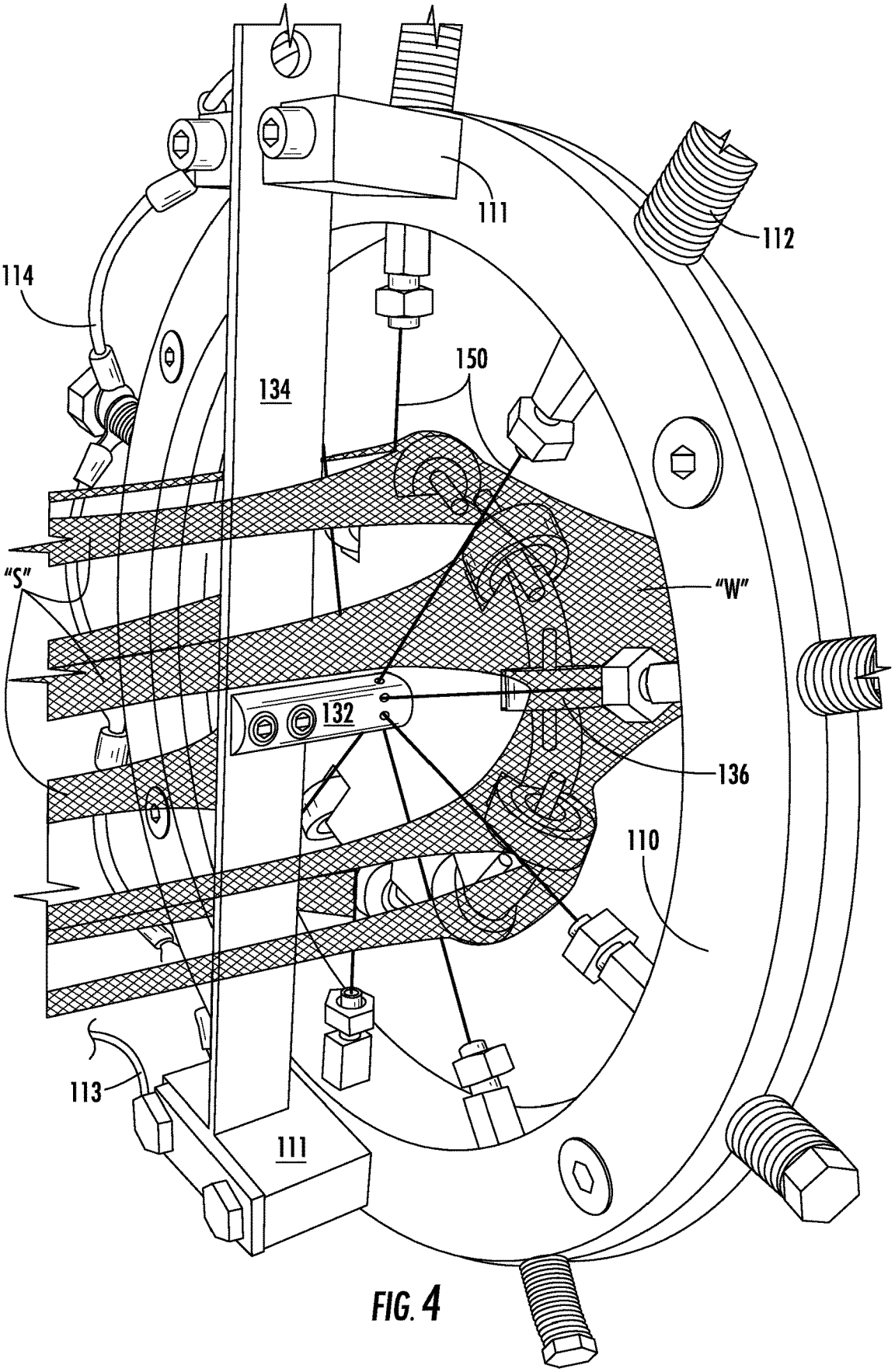
FIG. 4 is a perspective view of a tubular workpiece being cut into strips or ribbons by the device of FIG. 1.

In an illustrative example of the method of operation seen, for example in FIG. 4, first an end of the tubular workpiece "W" is withdrawn from a spool and stretched over infeed mandrel 130 and roller wheels 136. Electrical power is then provided to the device and the wires are heated to the desired temperature. The end of the tubular workpiece is then pulled through the heated cutting elements, being slit as it passes. The resulting strips "S" are then fed into a mechanically driven nip roller (not shown) which applies a suitable withdrawing force on the supply of tubular workpiece to continually pull the tubular workpiece in a linear course of travel across the radially arrayed cutting members to provide strips of uniform width. The strips "S" may then be collected, prepared for collection, or fed towards another processing step.

In another illustrative embodiment shown in FIGS. 5-10, device 200 includes frame 210, infeed mandrel 230, exit mandrel 250, and cutting members 270.

Figure 6:
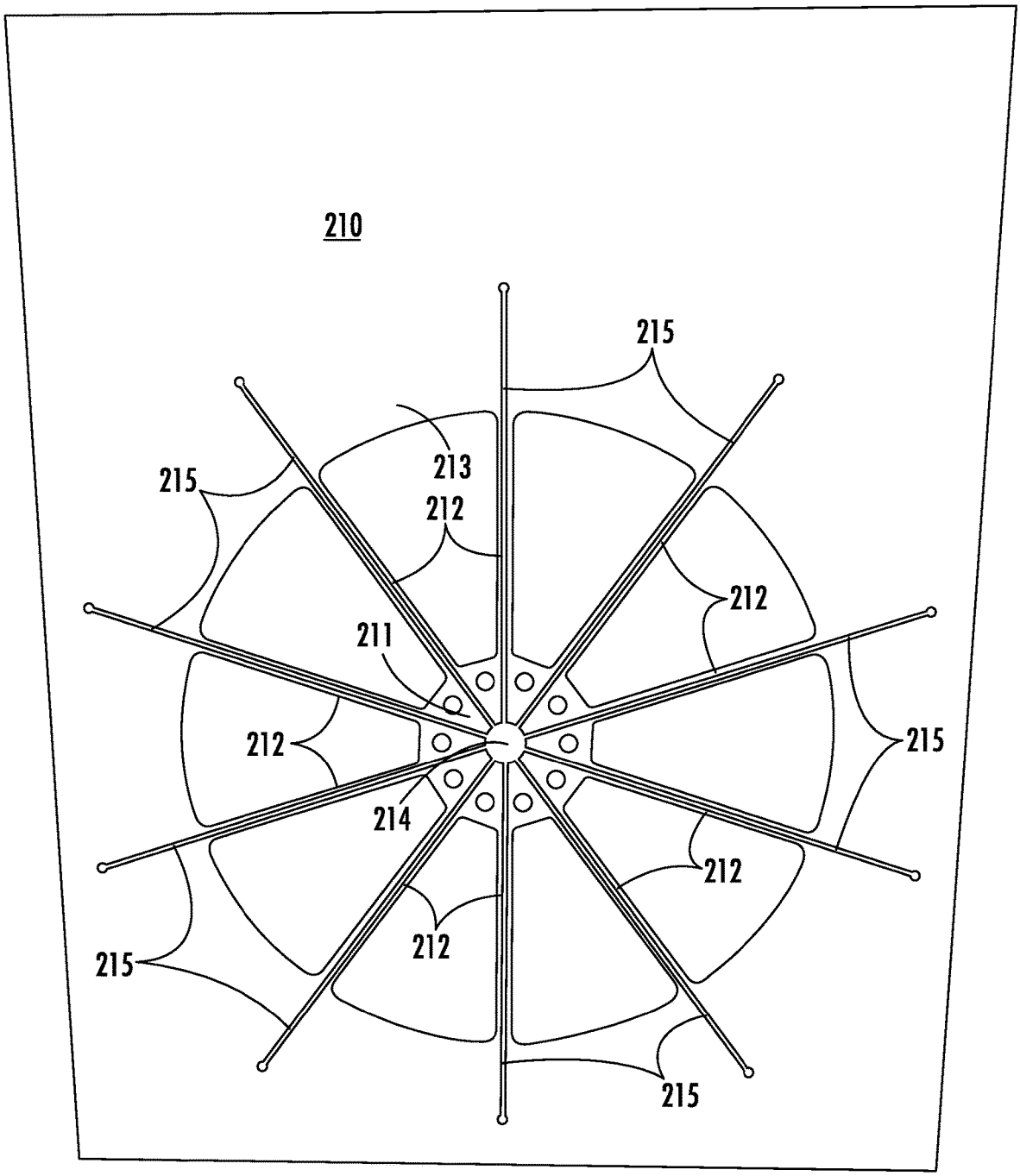
FIG. 6 is a top view of the upstream side of the frame of the device of FIG. 5.
Figure 7:
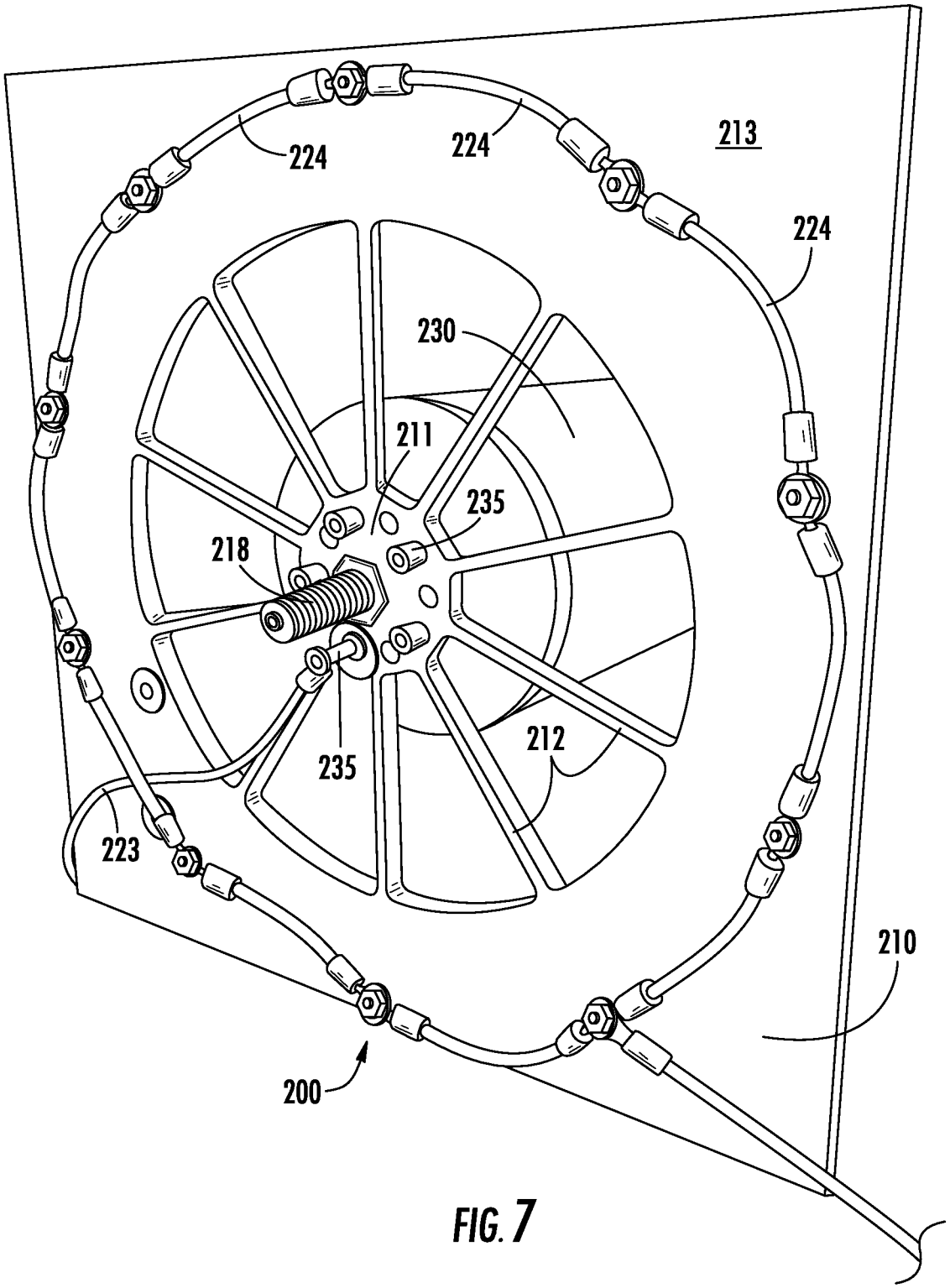
FIG. 7 is a perspective view of the device of FIG. 5 with the exit mandrel removed.

As seen in FIG. 6, frame 210 includes a central portion 211, and a series of struts 212 extending from central portion 211 to outer portion 213 of frame 210. Central portion 211 of frame 210 includes a central opening 214 for receiving central rod 218, which supports other components of the device. Slots 215 may be provided in struts 212 and frame 210 to avoid any damage from heating of cutting members 270. Frame 210 may be made of materials and methods similar to those previously discussed in connection with frame 110, and central rod 218 may be made of similar materials to central rod 132. As seen in FIG. 7, central rod 218 extends in the upstream direction from frame 210 to support infeed mandrel 230 and in downstream direction from frame 210 to support exit mandrel 250. Portions of central rod 218 (e.g., upstream and downstream portions) may be threaded or include other structure configured to facilitate attachment of other components to center rod 218.

Figure 8:
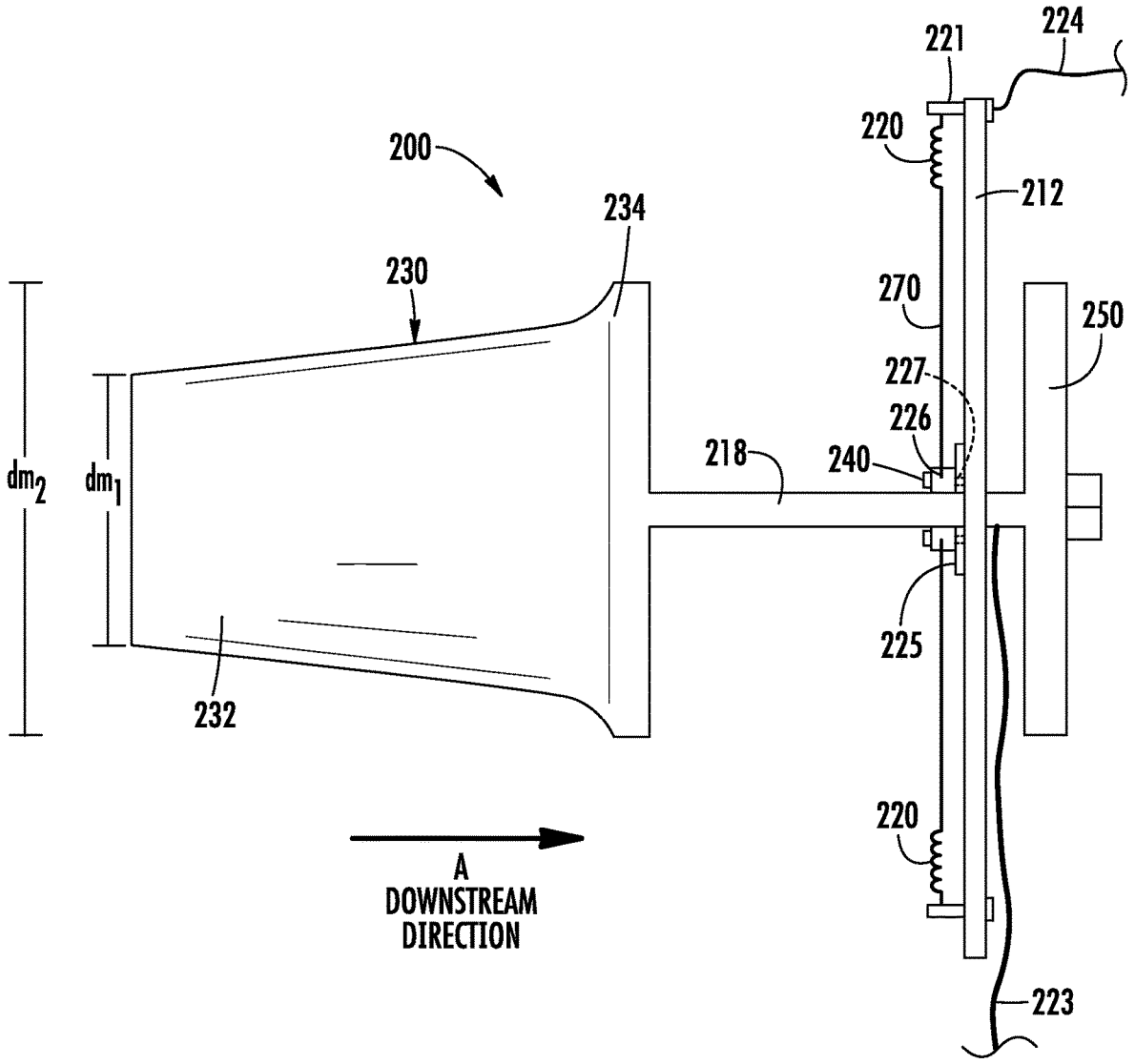
FIG. 8 is a cross-sectional view of the device of FIG. 5.
Figure 9:
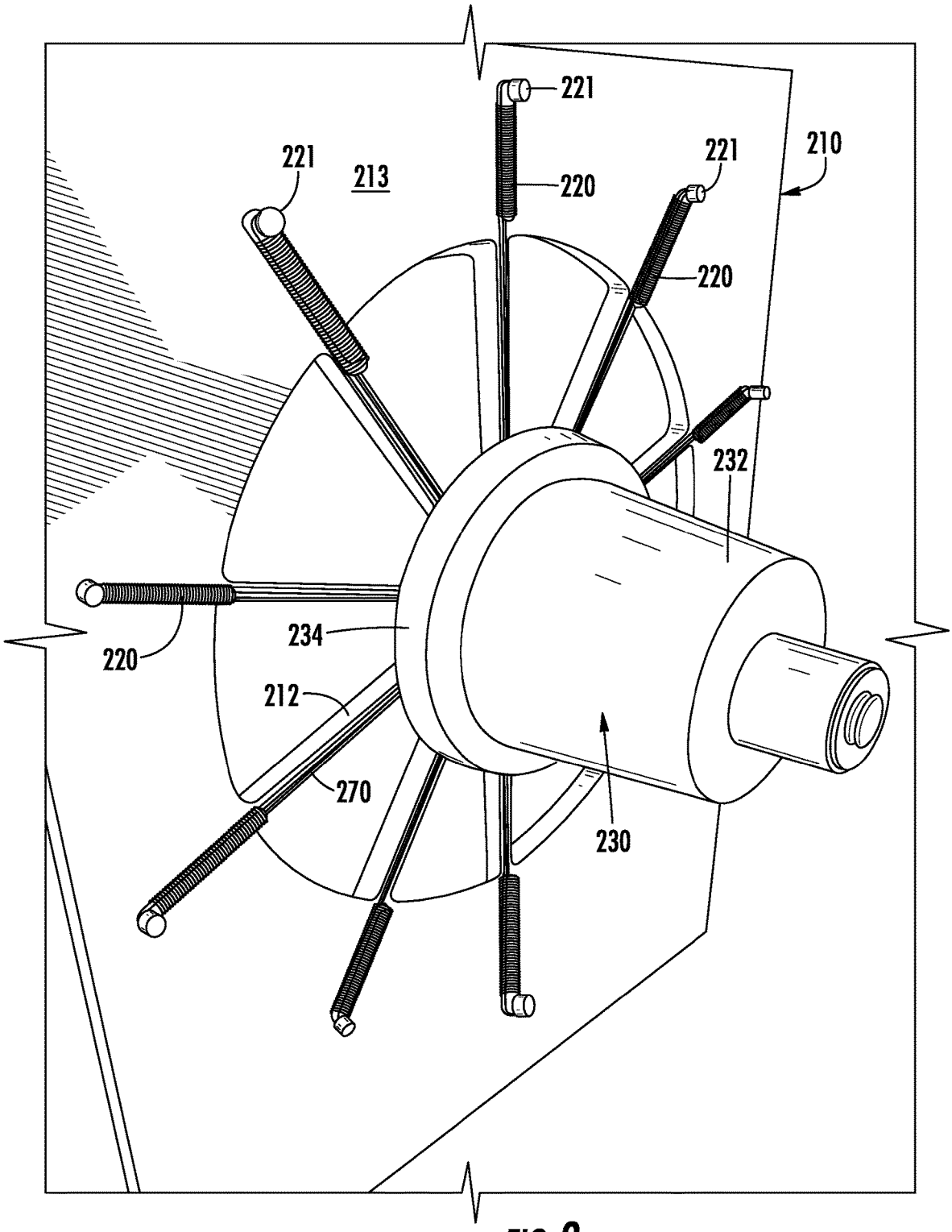
FIG. 9 is a perspective view of the device of FIG. 5 showing the infeed mandrel.

As best seen in FIGS. 8 and 9, infeed mandrel 230 includes a first, upstream portion 232 and a second, downstream portion 234. The diameter "$d_{m1}$" of upstream portion 232 of infeed mandrel 230 may be smaller than the unexpanded or "at rest" diameter of the tubular workpiece to be cut. Accordingly, the tubular workpiece can be easily positioned over upstream portion 232 of infeed mandrel 230. The diameter "$d_{m2}$" of downstream portion 234 of infeed mandrel 230 is larger than the diameter of the unexpanded tubular workpiece. Thus, as the tubular workpiece is pulled in the downstream direction over second portion 234 of infeed mandrel 230, the diameter of the tubular workpiece will be expanded, radially stretching the tubular workpiece in preparation for cutting. In some embodiments, the infeed mandrel expands the diameter of the tubular workpiece from about 5% to about 25% of the unexpanded or at rest diameter of the tubular workpiece. Infeed mandrel 230 may be solid or hollow, and made from a smooth, low friction material to allow the tubular workpiece to pass easily over the surface of the infeed mandrel, thereby removing the need for any roller wheels.

Exit mandrel 250 is positioned downstream of frame 210. Exit mandrel 250 may have a diameter that is substantially similar to the diameter "$d_{m2}$" of the downstream second portion 234 of infeed mandrel 230. Because the diameters of exit mandrel 250 and second portion 234 of infeed mandrel 230 are similar, the tubular workpiece may be fed along a relatively straight path over exit mandrel 250 after it is cut. This straight path helps to limit unwanted motion of the cut workpiece to ensure consistent production of precise strips, and may keep the strips of the cut workpiece separated to prevent any tangling or other interaction which may be detrimental to the processing of the tubular workpiece.

Figure 10:
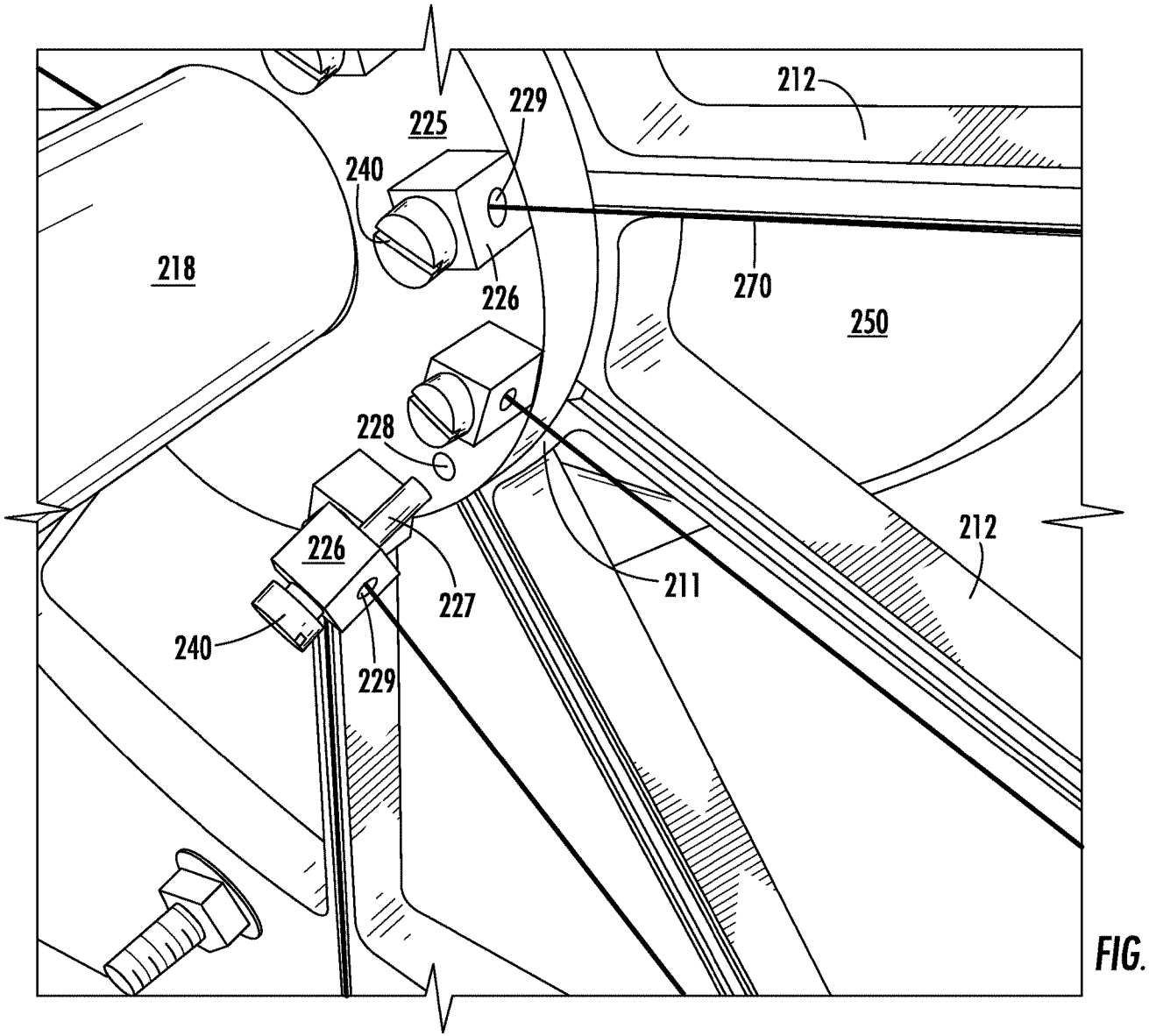
FIG. 10 is a close-up perspective view of the device of FIG. 5 showing the detail of on example of how wire cutting members may be secured to the inner portion of the frame.

As in the previous embodiment, cutting members 270 are mounted in a radial array. A first end portion of each cutting member 270 is mounted to a plate 225 mounted on the upstream side of frame 210 as seen in FIG. 10. Blocks 226 are mounted to plate 225 by pins 227 which may be secured by friction fit in holes 228. Cutting members 270 may be inserted into through-holes 229 in blocks 226 and secured therein by setscrews 240. Each of plate 225, pins 227, blocks 226 and setscrews 240 may individually be made of any electrically conductive material, including but not limited to those previously mentioned herein.

A second end portion of each cutting member 270 is mounted to outer portion 213 of frame 210 under tension. Frame 210 includes a series of pins 221 that extend through outer portion 213 of frame 210. Tension springs 220 are secured to pins 221, and serve similar functions to the spring loaded plungers 112 described in connection with the previous embodiment.

Springs 220 may be part of the circuit that serves to power cutting elements 270. In the illustrative embodiment shown in FIGS. 5-10, power is provided to plate 225, for example via wire 223 through bolts 235 used to mount plate 225 to inner portion 211 of frame 210 as seen in FIG. 7. The current passes through wire cutting members 270, and then through springs 220 and pins 221. Wires 224 connect cutting members 270 in series, and to provide them with an electric current and to complete the circuit.

In an illustrative example of the method of operation of the device shown in FIGS. 5-10, an end of the tubular workpiece is withdrawn from a spool and stretched over infeed mandrel 230. Electrical power is then provided to the device and the wires 270 are heated to the desired temperature. The end of the tubular workpiece is then pulled through the heated cutting members (being slit as it passes) and the strips pass over exit mandrel 250. The strips are then fed into a mechanically driven nip roller (not shown) which applies a suitable withdrawing force on the supply of tubular workpiece to continually pull the tubular workpiece across the radially arrayed cutting members to provide strips of uniform width. The strips may then be collected, prepared for collection, or fed towards another processing step.

Figure 11:
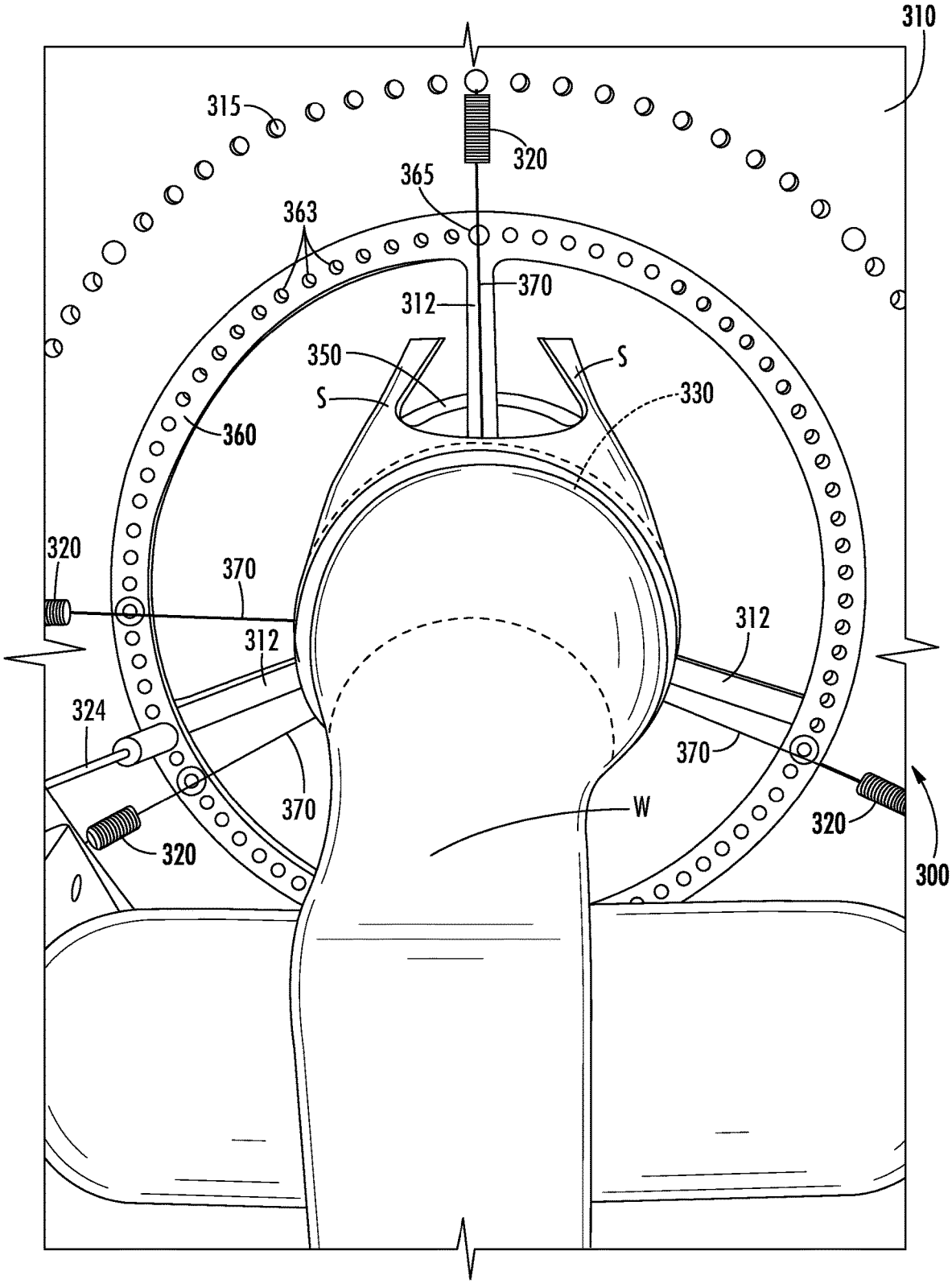
FIG. 11 is a view in the downstream direction of another exemplary embodiment of a slitting device in accordance with the present disclosure wherein the position of the cutting members can be adjusted.
Figure 12:
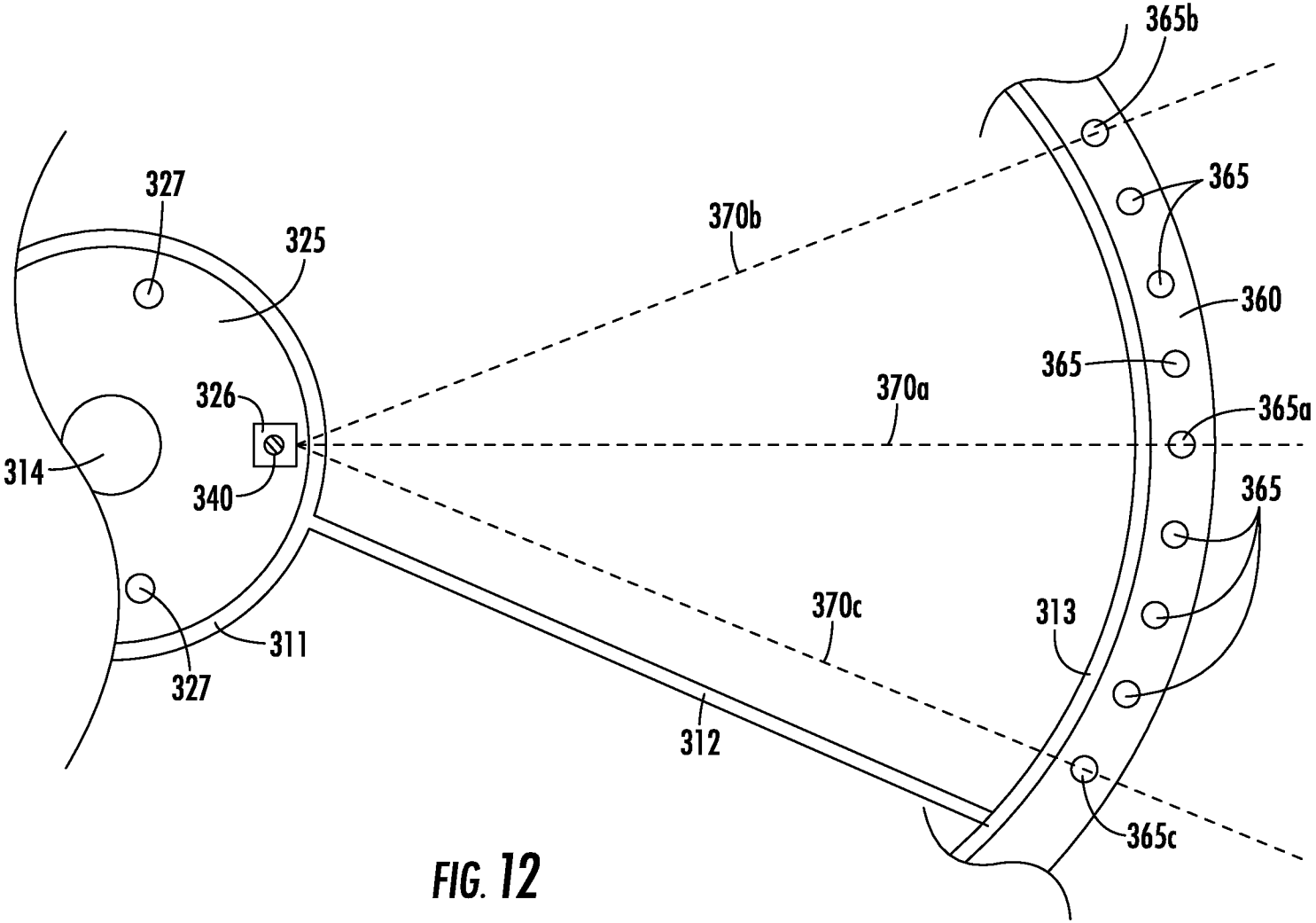
FIG. 12 schematically shows adjustment of a cutting member to three different positions in the device of FIG. 10.

In another illustrative embodiment shown in FIGS. 11-12, device 300 includes frame 310, infeed mandrel 330, exit mandrel 350, and cutting members 370. In this embodiment, infeed mandrel 330, exit mandrel 350, and cutting members 370 are substantially similar to the previously described infeed mandrel 230, exit mandrel 250, and cutting members 270; however, because of differences in frame 310 (compared to frames 110 and 210), the position of cutting members 370 can be easily adjusted to change the width of the strips or ribbons produced by device 300.

As seen in FIGS. 11 and 12, frame 310 includes a central portion 311 (not explicitly shown in FIG. 11), and a series of struts 312 extending from central portion 311 to outer portion 313 of frame 310. While the illustrative embodiment of FIG. 11 includes three struts 312, it should be understood that more or less than three struts may be present on frame 310. Central portion 311 of frame 310 includes a central opening 314 for receiving central rod (not explicitly shown), which supports other components of the device. Frame 310 may be made of materials and methods similar to those previously discussed in connection with frames 110 and 210.

As in the previous embodiments, cutting members 370 are mounted in a radial array. A first end portion of each cutting member 370 is secured to a plate 325 mounted on the upstream side of frame 310. Blocks 326 are mounted to plate 325 in a similar manner to the previous embodiment (e.g., by pins (not shown) which are secured in holes (not shown).

Cutting members 370 may be inserted into through-holes in blocks 326 and secured therein by setscrews 340.

A second end portion of each cutting member 370 is mounted to outer portion 313 of frame 310 under tension. Frame 310 includes a series of indexed threaded holes 315 used to affix the second end portion of each cutting member 370. Each cutting member 370 is secured to a tension spring 320 which is, in turn, secured to a threaded pin 321 that, when threaded into one of the threaded holes 315, extends through outer portion 313 from the upstream side to the downstream side of frame 310. Springs 320 serve a similar tensioning function as the springs 220 and spring-loaded plungers 112 described in connection with the previous embodiments.

In the embodiment of FIGS. 11-12, however, springs 320 are not part of the circuit that serves to power cutting members 370. Rather, frame 310 includes a conductive ring 360 mounted thereto. Conductive ring 360 includes holes 363, in embodiments corresponding in number to the number of indexed threaded holes 315. Each hole 363 may be provided with a pin wire guide 365 including a slot 366 through which a cutting member 370 passes. In the illustrative embodiment shown in FIGS. 11-12, power is provided to plate 325, (for example through bolts 327 used to mount plate 325 to inner portion 311 of frame 310 in a manner similar to the previous embodiment. The current passes through wire cutting members 370, and then through pin wire guide 365 and conductive ring 360. Wire 324 is connected to conductive ring 360, which in turn connects cutting elements 370 in series, to provide them with an electric current and to complete the circuit.

To adjust the width of the strips or ribbons produced by the device, with the first end of cutting member 370 secured to block 326, pin 321 is removed from one of holes 315 and moved to a different one of holes 315. When repositioned into a different one of holes 315, cutting member 370 will fall into a slot 366 of the corresponding one of the pin wire guides 365. For example, as shown in FIG. 12, a single wire can be easily moved from a first position 370*a* in contact with pin wire guide 365*a*, to a second position 370*b* in electrical contact with pin wire guide 365*b*, or to a third position 370*c* in electrical contact with pin wire guide 365*c*, or to any other intermediate position at which a pin wire guide 365 is located. In this manner, device 300 is essentially a universal cutter that could be used to slit any combination of widths by the operator moving the wires around the perimeter, without significant modification to the apparatus.

While shown in FIG. 12 as a single wire secured within block 326, it should be understood that securing more than one wire within block 326 is contemplated. For example, rather than showing three alternative positions of a single wire, one skilled the art viewing FIG. 12 may easily envision three separate wires (370*a*, 370*b*, 370*c*) secured at a first end to a common block.

Figure 12A:
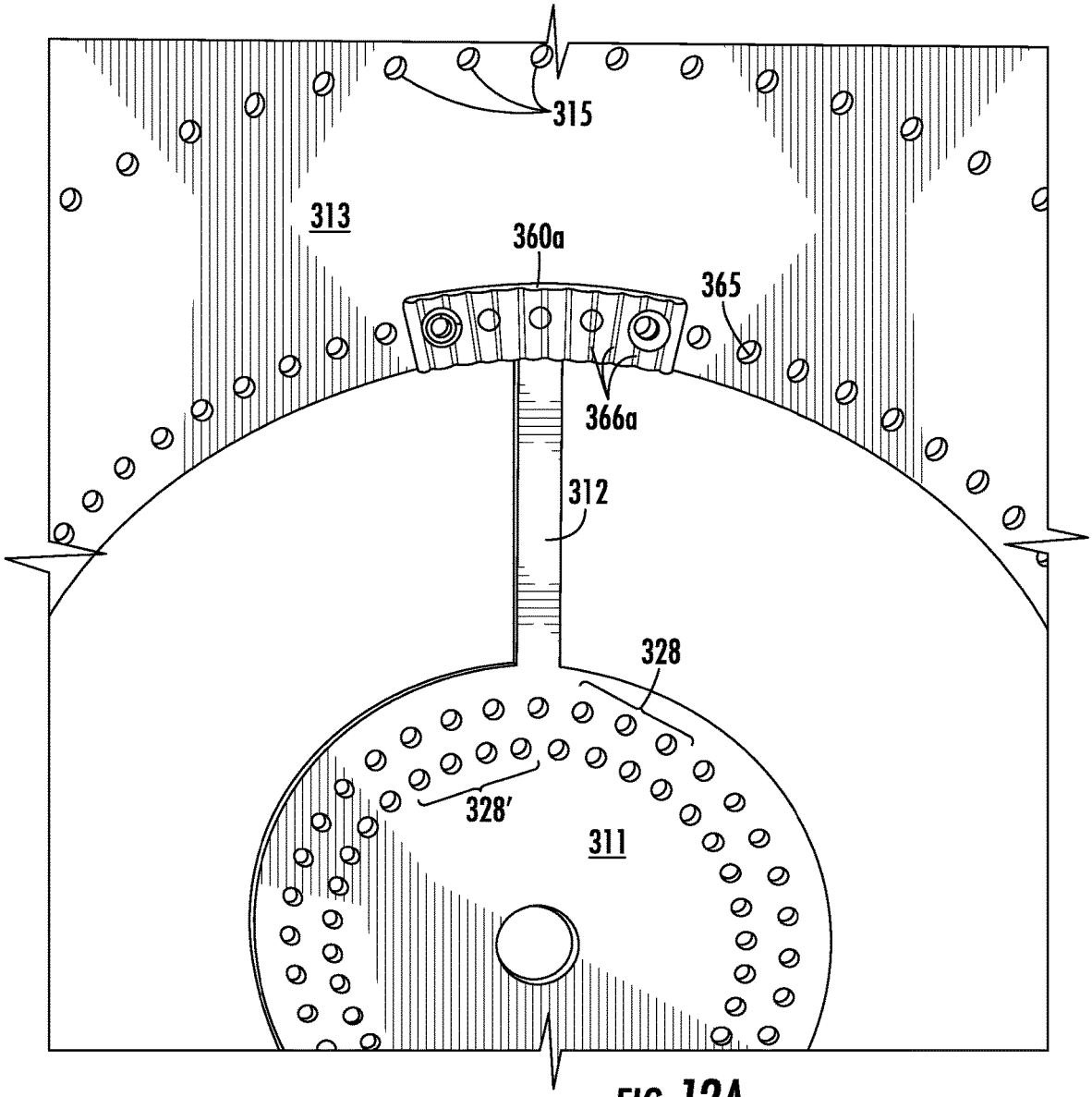
FIG. 12A is plan view of an alternative frame having a slotted plate mounted thereto to permit adjustment of the position of the cutting members.

In an alternative embodiment of a frame shown in FIG. 12A, concentric, off-set rings of holes 328, 328' are provided on inner portion 311 of frame 310 which can be used with conductive blocks (not shown) to secure a first end of cutting wires. A second end portion of each cutting wire is mounted to outer portion 313 of frame 310 under tension using pins (not shown) extending through indexed holes 315. A slotted conductive plate 360*a* is secured to outer portion 313 of frame 310, with the wires being adjusted so that they are positioned within a slot 366*a* of plate 360*a*.

Once the positions of the cutting members are set, operation of device 300 is similar to operation of device 200. In an illustrative example of the method of operation of the device 300, as seen in FIG. 11, an end of the tubular workpiece "W" is withdrawn from a spool and stretched over infeed mandrel 330. Electrical power is then provided to the device and the wires 370 are heated to the desired temperature. The end of the tubular workpiece is then pulled through the heated cutting members (being slit as it passes) and the resulting strips "S" pass over exit mandrel 350. The strips "S" are then fed into a mechanically driven nip roller (not shown) which applies a suitable withdrawing force on the supply of tubular workpiece to continually pull the tubular workpiece across the radially arrayed cutting members to provide strips of uniform width. The strips may then be collected, prepared for collection, or fed towards another processing step.

Figure 13:
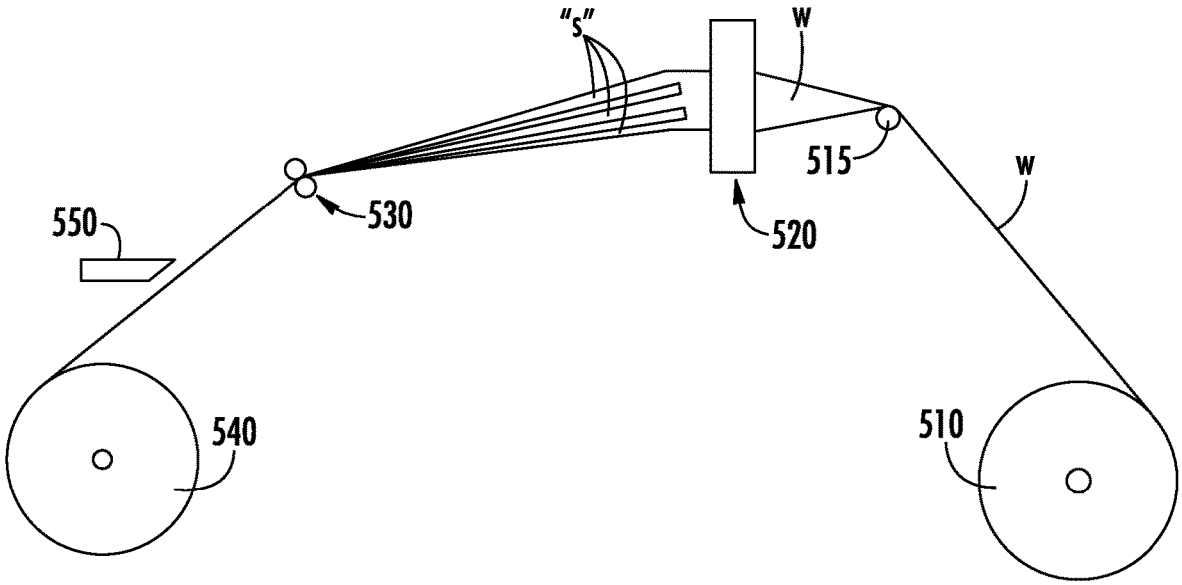
FIG. 13 is schematic view of a system incorporating a slitting device in accordance with the present disclosure.

Any of the foregoing embodiments of slitting devices may be incorporated into a system for cutting a tubular workpiece into strips, such as the system schematically shown in FIG. 13. The system includes a source of tubular workpiece stock, such as spool 510. After being withdrawn from spool 510, the tubular workpiece may pass over an infeed roller 515 and passed to a slitting station 520 (including a cutting device in accordance with the principles or any embodiment of the present disclosure including, for example, radially arrayed cutting members) where it is expanded and cut to form strips "S" from the tubular workpiece. The strips are then collected and fed into a drive mechanism, such as nip rollers 530 for pulling the tubular workpiece through the slitting station. Downstream of the drive mechanism, the strips are directed to a collection station. In embodiments, the collection station includes one or more spools 540 upon which the strips may be wound. In embodiments, the system further includes a cutting station 550 to cut the strips into desired lengths. In such embodiments, the collection station may be a container (not shown) into which strips of a desired length may be collected.

Figure 14:
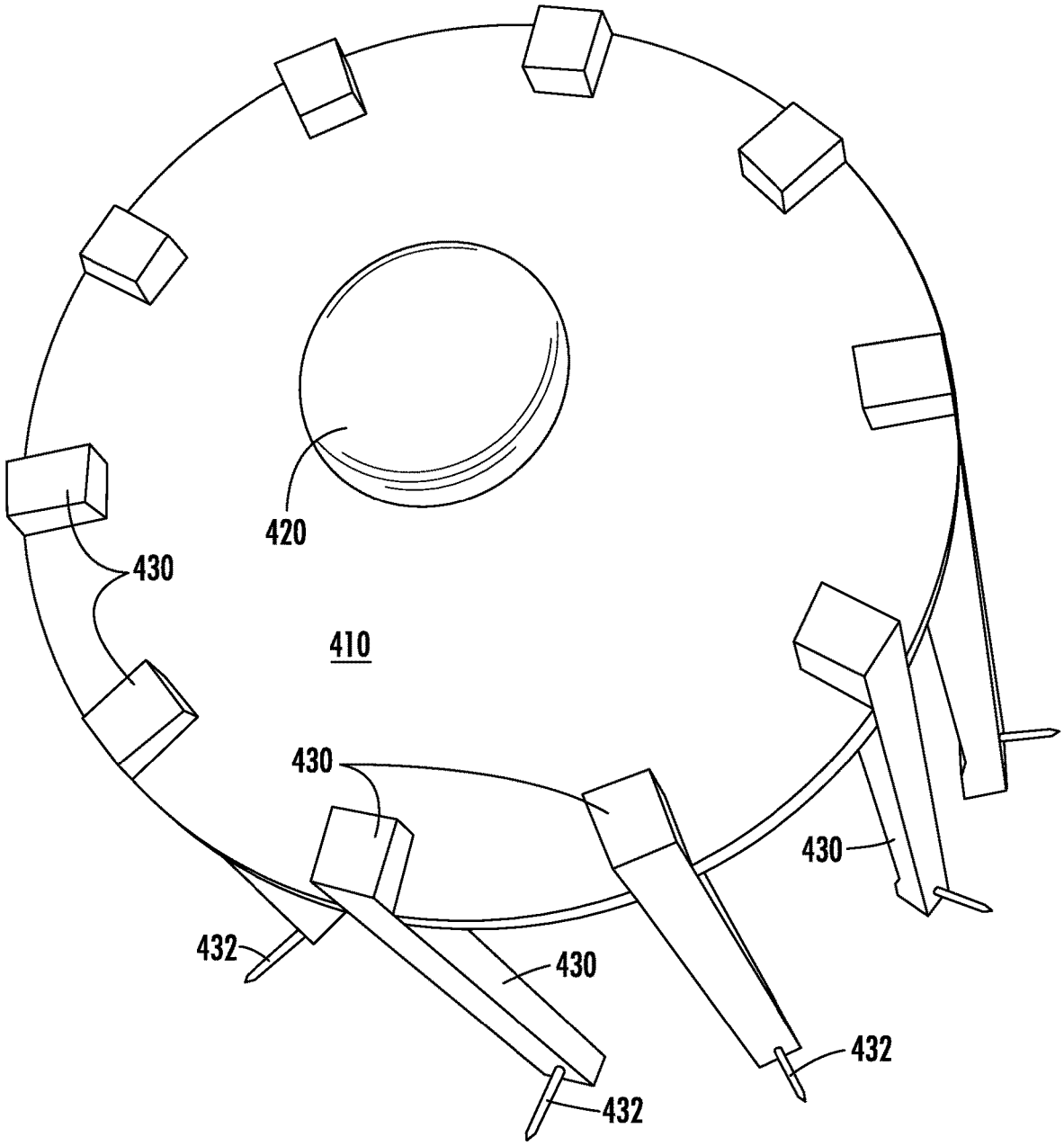
FIG. 14 is a perspective view from the handle side of an illustrative embodiment of a threading tool for use in setting up a slitting device in accordance with the present disclosure.
Figure 15:
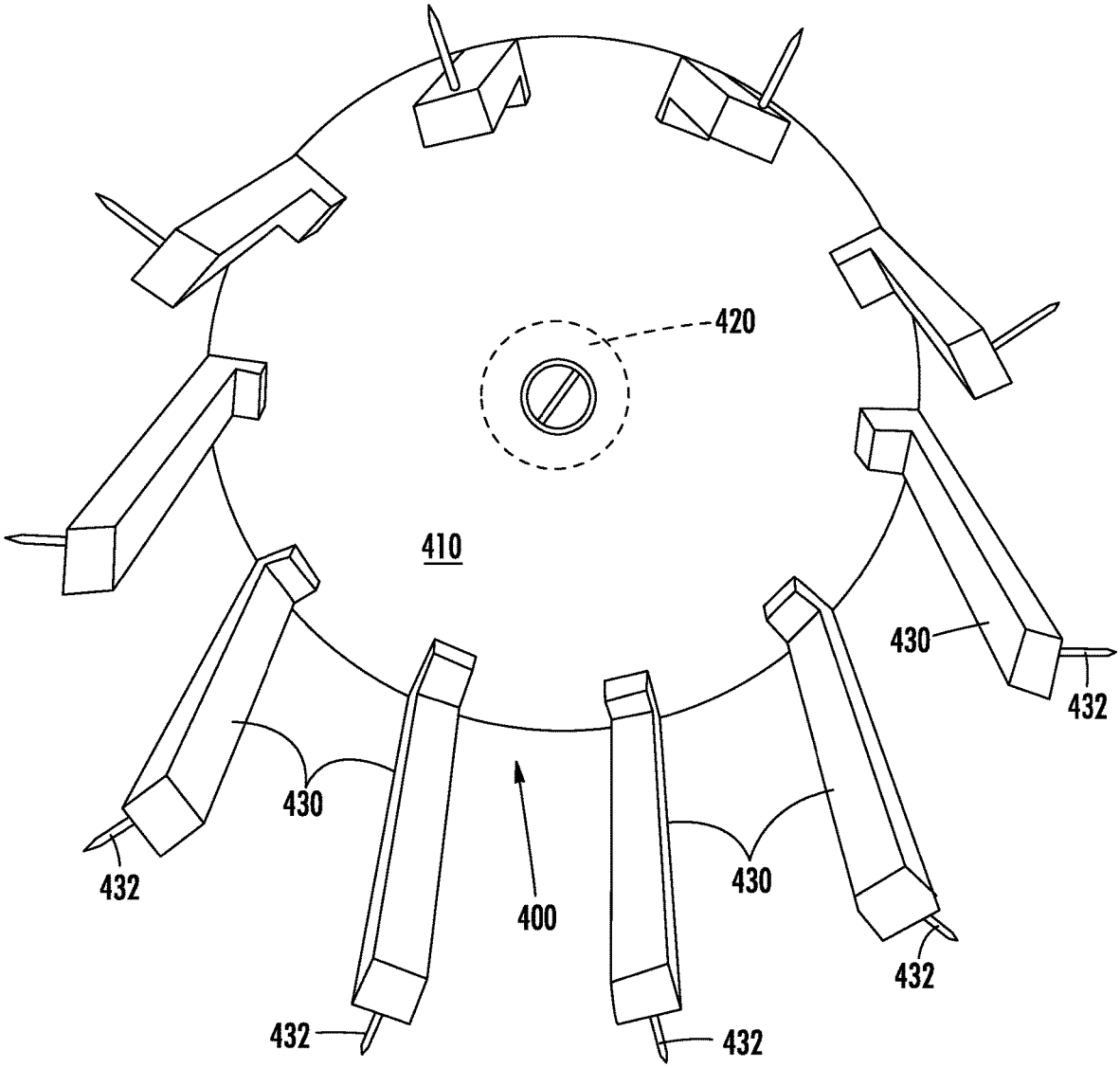
FIG. 15 is a perspective view from the finger side of the threading tool of FIG. 14.
Figure 16:
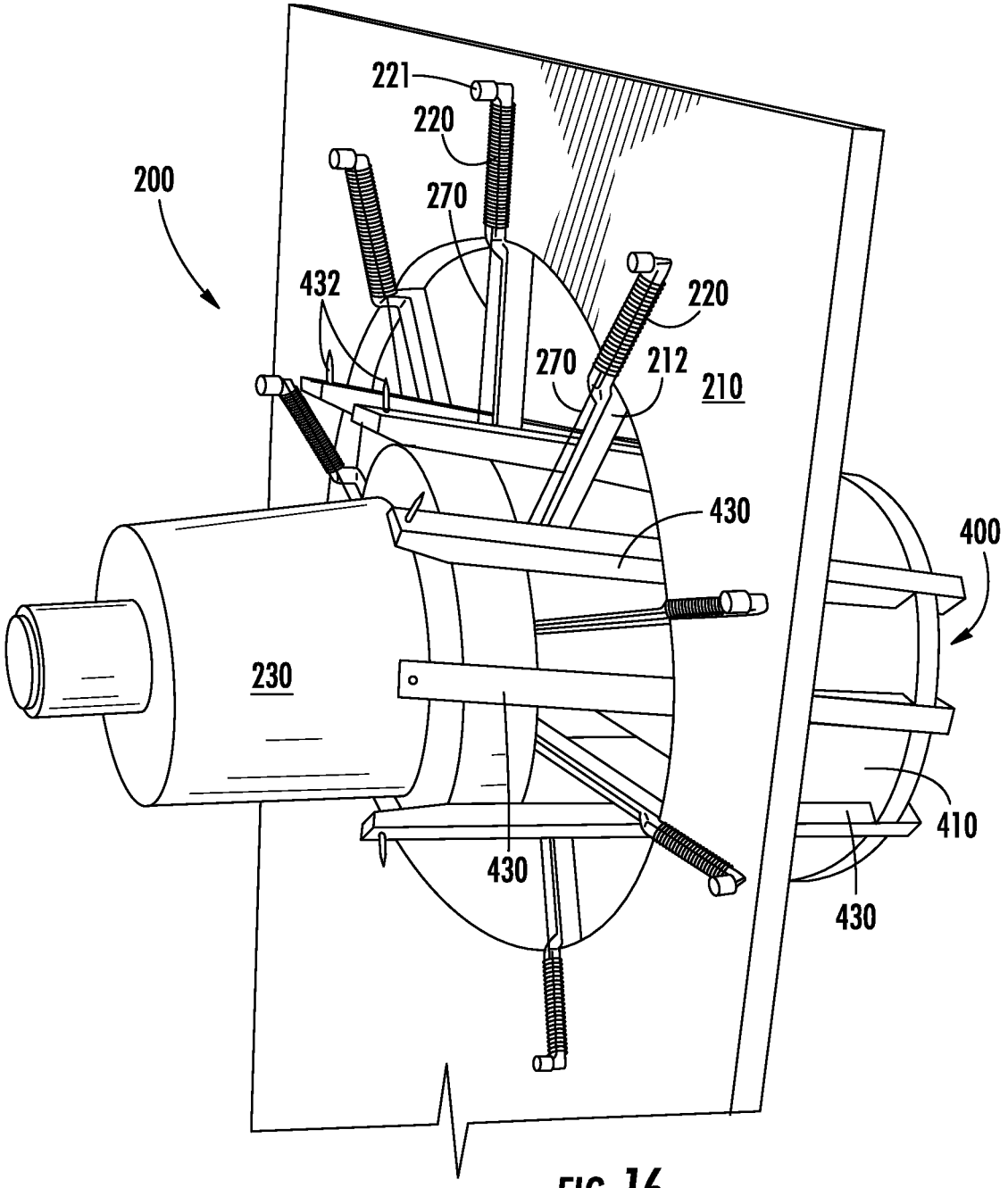
FIG. 16 is a view of the threading device of FIG. 14 threading the slitting device of FIG. 5.

Because during initial start up of the device the tubular workpiece is fed through the slitting device which may include exposed cutting members (in embodiments, wires that are electrified and very hot), a tool that includes of a series of "fingers" may be used to safely thread the apparatus. The tool keeps the operator's hands a safe distance from the cutting members while also ensuring that the tubular workpiece is pulled through the slitting device evenly at the start. An illustrative embodiment of a threading tool 400 is shown in FIGS. 14-16.

Threading tool 400 includes a body 410, a handle 420, and a plurality of fingers 430. Body 410 may be made from any non-conductive, thermally stable, rigid material. Handle 420 may be attached to a first side of body 410 near the center thereof to promote balance, and easy manipulation of the threading tool. Fingers 430 are secured to body 410 and extend away from a second side of body 410.

Fingers 430, which may be arranged radially around the circumference of body 410, may extend substantially perpendicularly from body 410 and parallel to each other. While the illustrative embodiment of FIG. 14 includes ten fingers 430, it should be understood that more or less than ten fingers may be employed in tool 400. The number of fingers 430 may, in embodiments be as few as three, provided that the tubular workpiece is sufficiently secured on tool 400 to be pulled evenly through the cutting members. The spacing between adjacent fingers should be sufficient to allow fingers 430 to be placed between adjacent cutting members of the slitting device and to surround the infeed mandrel. Fingers 430 should be of a sufficient length to allow a user to safely extend tool 400 through the cutting members of the slitting device, while maintaining his/her hands a safe distance (on both the upstream and downstream sides) from the cutting members of the slitting device through which the tubular workpiece is being threaded.

Each finger 430 includes a barb 432 near the free end thereof. Barb 432 may have a sharpened point that can easily pierce a tubular workpiece, allowing a user of tool 400 to secure the tubular workpiece to the tool, while also ensuring that the tubular workpiece does not slide off of fingers 430 while the user attempts to thread a slitting device. In the illustrative embodiment of FIG. 14, barbs 432 point outward from fingers 430 in a direction that is substantially perpendicular to fingers 430. In alternative embodiments, barbs 432 are angled in the direction of body 410 to allow the barbed fingers to slip easily into the tubular workpiece, and to securely snag the tubular workpiece as the tool is pulled in the downstream direction through the cutting members.

Figure 5:
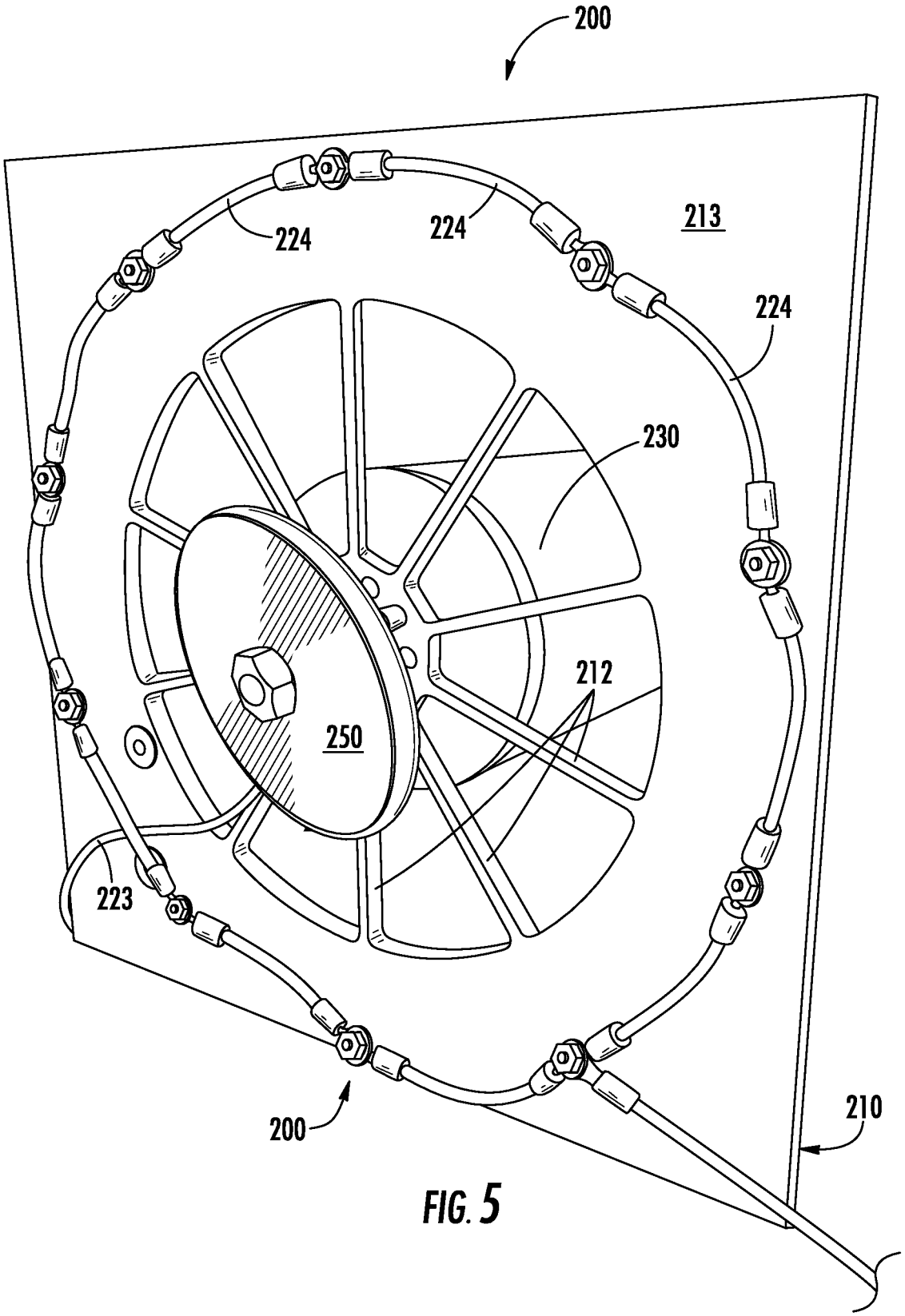
FIG. 5 is a perspective view of another exemplary embodiment of a slitting device in accordance with the present disclosure.

As seen in FIG. 16, to thread a slitting device, for example the embodiment of a slitting device shown in FIG. 5, using tool 400, a user holds handle 420 and (from the downstream side of frame 210) positions fingers 430 of threading tool 400 around exit mandrel 250, through the radially arrayed cutting elements, so that each finger passes between adjacent cutting members and the fingers 430 surround the infeed mandrel 230. On the upstream side of a frame 210, tubular workpiece is pulled over fingers 430, ensuring that the tubular workpiece is pierced by barbs 432 to prevent the workpiece from sliding off fingers 430. Once the tubular workpiece is secured to tool 400, the user then pulls tool 400, and hence the tubular workpiece, downstream through the slitting device. As the workpiece passes across the cutting members, it is cut into strips. The strips are then collected and fed into a drive mechanism for pulling the tubular workpiece through the slitting station at a uniform and steady pace.

While several embodiments of the present slitting devices have been shown in the drawings and described, it is not intended that the present disclosure be limited thereto, as it is intended that the disclosure be as broad in scope as the art will allow and that the specification be read likewise. It should be understood that the foregoing description is only illustrative of the present disclosure. Various alternatives and modifications can be devised by those skilled in the art without departing from the disclosure. Such modifications and variations are intended to be included within the scope of the present disclosure. In addition, the features illustrated or described in connection with one exemplary embodiment may be combined with the features of other embodiments. Therefore, the above description should not be construed as limiting, but merely as exemplifications of presently disclosed embodiments.

What is claimed is:

1. A device comprising;

an infeed mandrel having an outer surface configured to receive a tubular workpiece therearound;

a frame having a body and at least one opening;

a support structure secured to and spanning across a width of the frame, the support structure having a stationary central rod mounted thereon, the stationary central rod positioned near a central portion of the frame and extending towards a central portion of the infeed mandrel;

a plurality of cutting members supported on and extending radially outward from the stationary central rod to the body of the frame; and a power source coupled to the cutting members and configured to heat the cutting members to cut the tubular workpiece.

2. A device according to claim 1, wherein the plurality of cutting members are wires.

3. A device according to claim 2, wherein the wires are heated by a circuit including the wires and the power source.

4. A device according to claim 1, wherein the plurality of cutting members are supported on the frame under tension.

5. A device according to claim 1 wherein;

the infeed mandrel is configured to be positioned within, and to expand a diameter of, the tubular workpiece.

6. A device according to claim 5, wherein the infeed mandrel includes an upstream portion having a first diameter and a downstream portion having a diameter larger than the diameter of the upstream portion of the infeed mandrel.

7. A device according to claim 6, wherein the diameter of the upstream portion of the infeed mandrel is less than an unexpanded diameter of the tubular workpiece, and the diameter of the downstream portion of the infeed mandrel is greater than the unexpanded diameter of the tubular workpiece.

8. A device according to claim 5 further comprising an exit mandrel.

9. A system for cutting a tubular workpiece into strips comprising;

a source of tubular workpiece stock material;

a slitting station including a device according to claim 8;

a drive mechanism; and a collection station.

10. A system according to claim 9, wherein the drive mechanism includes a nip roller for pulling cut strips of material through the slitting station.

11. A system according to claim 9, wherein the collection station includes a spool around which the strips may be stored.

12. A system according to claim 9 further comprising a cutting station for cutting the strips to a desired length prior to reaching the collection station.

13. A device according to claim 1 wherein;

the frame includes a plurality of apertures on a central portion of the frame, each aperture configured to secure a first end of a cutting member, and a plurality of holes on a peripheral portion of the frame, each of the plurality of holes configured to secure a second end of the cutting member; and wherein each cutting member of the plurality of cutting members extends from the central portion of the frame to the peripheral portion of the frame.

14. A device according to claim 13, wherein a position of the second end of a cutting member of the plurality of cutting members can be moved from a first hole of the plurality of holes to a second hole of the plurality of holes.

15. A device according to claim 13, further comprising a conductive ring secured to the frame, an intermediate portion of the plurality of cutting members contacting the conductive ring.

16. A device according to claim 1, wherein the support structure is a strut.

17. A device according to claim 1, wherein each cutting member of the plurality of cutting members includes a first end connected to the stationary central rod, and a second end connected to the frame.

18. A device according to claim 1, wherein the stationary central rod is secured to a central portion of the infeed mandrel.

19. A device comprising;

a frame having a body and at least one opening;

a stationary central rod positioned near a central portion of the at least one opening;

a support structure, the support structure secured both to the frame and to the stationary central rod;

an infeed mandrel configured to receive a tubular workpiece therearound;

a plurality of cutting members supported on and extending radially outward from the stationary central rod towards the body of the frame;

a power source coupled to the plurality of cutting members and configured to heat the cutting members to cut the tubular workpiece; and wherein the stationary central rod extends towards a central portion of the infeed mandrel.

20. The device of claim 19, wherein the plurality of cutting members are supported on the frame under tension.

21. The device of claim 19 further comprising a plurality of spring loaded plungers coupled to the cutting members.

22. The device of claim 21, wherein the spring loaded plungers couple the power source to the cutting members.

23. The device of claim 19, wherein the infeed mandrel includes a substantially circumferential outer surface configured to receive and support the tubular workpiece around the outer surface.

* * * * *